US006547909B1

(12) United States Patent
Butterworth

(10) Patent No.: US 6,547,909 B1
(45) Date of Patent: Apr. 15, 2003

(54) FLYING WEB SPLICE APPARATUS AND METHOD

(75) Inventor: Tad T. Butterworth, Ashland, WI (US)

(73) Assignee: C. G. Bretting Mfg. Co., Inc., Ashland, WI (US)

( * ) Notice: Subject to any disclaimer, the term of this patent is extended or adjusted under 35 U.S.C. 154(b) by 0 days.

(21) Appl. No.: 09/551,369

(22) Filed: Apr. 18, 2000

Related U.S. Application Data

(63) Continuation of application No. 09/119,367, filed on Jul. 20, 1998, now Pat. No. 6,051,095.

(51) Int. Cl.[7] ..... B65H 9/18

(52) U.S. Cl. ..... 156/157; 156/504; 156/507; 242/554.6; 242/555.1; 242/555.2; 242/555.3

(58) Field of Search ..... 156/157, 285, 156/286, 381, 382, 502, 504, 507; 242/554.6, 555, 555.1, 555.2, 555.3

(56) References Cited

U.S. PATENT DOCUMENTS

| | | | | |
|---|---|---|---|---|
| 3,252,671 A | | 5/1966 | Phillips et al. | |
| 3,627,616 A | | 12/1971 | Davis | 156/355 |
| 3,780,960 A | | 12/1973 | Tokuno et al. | |
| 4,082,589 A | | 4/1978 | Patterson et al. | 156/98 |
| 4,100,012 A | | 7/1978 | Melhofer et al. | |
| 4,106,974 A | | 8/1978 | Hirsch | 156/504 |
| 4,132,371 A | | 1/1979 | Byrt | |
| 4,188,257 A | * | 2/1980 | Kirkpatrick | 156/504 |
| 4,352,468 A | | 10/1982 | Feldkamper et al. | |
| 4,363,695 A | | 12/1982 | Marass | |
| 4,875,633 A | | 10/1989 | Mochizuki et al. | |
| 5,252,170 A | | 10/1993 | Schaupp | |
| 5,253,819 A | | 10/1993 | Butler | |
| 5,360,502 A | * | 11/1994 | Andersson | 156/159 |
| 5,562,038 A | * | 10/1996 | Bierbaum et al. | 101/228 |
| 5,584,446 A | | 12/1996 | Delmore et al. | |
| 5,679,195 A | | 10/1997 | O'Dwyer et al. | 156/159 |
| 5,709,355 A | * | 1/1998 | Kinnunen et al. | 242/555.3 |
| 6,013,148 A | * | 1/2000 | Bluemle | 156/159 |
| 6,030,496 A | * | 2/2000 | Baggot et al. | 162/111 |

* cited by examiner

*Primary Examiner*—Michael W. Ball
*Assistant Examiner*—John T. Haran
(74) *Attorney, Agent, or Firm*—Michael Best & Friedrich LLP

(57) ABSTRACT

A flying web splice apparatus and method for splicing a moving web of material to another web of material without tape or adhesives being used at the splice. Two splicer assemblies are provided which each have a rotatable parent roll feeding web material into the splicer apparatus. Each splicer assembly has a series of substantially parallel vacuum belts and a series of vacuum boxes therein. The vacuum boxes for each splicer assembly are evacuated by a vacuum blower, which creates a vacuum causing a suction through holes within a portion of the vacuum belts in order to hold web material to the vacuum belts. The series of belts for each splicer assembly are preferably rotatable about a top pivot to bring a bottom portion of each series of belts together. Preferably, at the bottom portions of each series of belts is located a pressure bonding mechanism, such as a series of ply-bond wheels, which bond the webs of material together when the bottom portions of the series of belts are brought together (preferably via one or more actuators). A stationary web from a parent roll is first placed over holes in one of the vacuum belts, which is then driven by a motor to drag the vacuum belt and web along part of its belt path and toward the pressure bonding mechanism. By the time the initially-stationary web reaches the actuated pressure bonding mechanism, the initially-stationary web is at the speed of the initially-moving web and can be precisely spliced thereto.

35 Claims, 8 Drawing Sheets

FLYING WEB SPLICE APPARATUS AND METHOD

This application is a continuation application of U.S. patent application Ser. No. 09/119,367, filed on Jul. 20, 1998, now U.S. Pat. No. 6,051,095.

FIELD OF THE INVENTION

The present invention relates to the field of web splicing, and more particularly, to the field of web splicing equipment for joining the ends of sheet material such as paper.

BACKGROUND OF THE INVENTION

The process of splicing a sheet (or "web") of material to another sheet of material is a common operation in a number of industries. In particular, in many paper industries, it is necessary to splice two webs of paper together in order to maintain a single unbroken web. This splicing operation is necessary for efficient operations downstream of the splicing equipment, which are fed with a steady and uninterrupted stream of web material. To maximize the efficiency of downstream operations, it is desirable to feed the web in a fast and steady manner without stopping or considerably changing the web speed. Conventional web splicing equipment is relatively inefficient, typically requiring the operator to stop the web or to significantly reduce web speed to splice the two ends of material.

In an effort to compensate for these inefficiencies, several conventional web splicing systems employ a variety of methods and assemblies to keep the web speed fed to downstream systems as fast and as continuous as possible. For example, as web material from an almost-expended roll (the "running roll") is fed at normal operating speed, certain systems will gradually bring a fresh roll of material (the "ready roll") up to the same speed, at which time the two webs are brought together and spliced. Such a system is disclosed in U.S. Pat. No. 3,252,671 issued to Phillips, Jr. et al. A drawback of such a system is that a large amount of web material which is fed through the splicer prior to the time the web speeds are matched is wasted during each splicing operation.

Other conventional web splicing systems perform their splicing operations by bringing the web from the ready roll up to speed very quickly. Such a system is disclosed in U.S. Pat. No. 5,252,170 issued to Schaupp. By bringing the ready roll web up to speed quickly, the material waste just described is avoided. However, systems which operate in this manner limit the types of web material which can be spliced. Many types of web material including, without limitation, toilet paper and tissue paper, are relatively low weight, low strength, and/or high stretch materials. Splicing operations performed by high-acceleration splicers on such materials perform poorly, and often result in ruptured webs or weak splices which are unable to withstand the rigors of downstream web operations.

Another disadvantage of many conventional web splicing systems (such as the one just described) is the manner in which the web splice is made. In particular, webs are often spliced by taping the ends of the two webs together. Especially in systems where the spliced area experiences a high amount of tension and/or in which the splicer does not provide a good speed match between the webs being spliced, a taped splice is often necessary. However, taped splices are undesirable because the spliced section of the web must eventually be removed from the web (for example, prior to the packaging of the final product) or the end products having the taped splice are must be discarded. Either method of discarding the tape spliced product section represents a waste of product. Furthermore, many tape splice systems require the operator to manually tape the two webs together. Not only does this typically require a section of both webs to be stationary for a period of time, but this is a labor-intensive inefficiency which is realized every time a splice is made.

As yet another example of how conventional web splicing systems attempt to feed downstream operations with a fast and continuous stream of web material through web splicing operations, certain systems use a bank of festoons or idler rolls immediately downstream of the splicer system. One such system is disclosed in U.S. Pat. No. 5,360,502 issued to Andersson. The festoon or idler rolls in such systems are adjusted to accommodate a significant amount of web material during normal web operations. When a web splicing operation is performed, the festoons or idler rolls move to release the web material wound therein. This process permits the web speed at the splice position (upstream of the festoons or idler rolls) to be temporarily reduced or stopped while the speed of the web material downstream of the festoons or idler rolls (i.e., for downstream machinery), is kept constant or only slightly reduced. When the splicing operation is complete, the web material passing the splicing area is brought back up to the speed of the web downstream of the festoons or idler rolls. A significant disadvantage of the web splicing system just described is the need for one or more banks of festoons or idler rolls and control elements and assemblies required for their operation. These components increase cost, maintenance, and floorspace requirements. Furthermore, it is of critical importance that a constant tension is maintained on the web throughout each operation performed upon the web. If constant tension is not maintained, web wrinkling and (in severe cases) web rupture can occur. Each festoon roll or idler roll added to a system creates web wrinkling and tensioning problems. Systems which attempt to address these problems by employing driven rolls in the bank of idler or festoon rolls inevitably introduce more expense, complexity, and maintenance costs into the system.

In view of the disadvantages of conventional web splicing systems noted above, there exists a need for a web splicing apparatus and method which can splice light weight, low strength, and high stretch web material without reducing the downstream speed of the web, which does not require additional elements or subsystems (e.g. a bank of festoon or idler rolls) to accommodate excess web material downstream of the splicer, and which can quickly and accurately accelerate a web up to the speed of a running web without the need for a taped splice and without the danger of web rupture during the splicing operation. The present invention provides such an apparatus and method.

SUMMARY OF THE INVENTION

An apparatus and method are provided for bonding one web of material (an "initially stationary web") to a moving web of material (an "initially moving web") without causing web rupture or web wrinkling. In order to quickly bring the initially stationary web up to the splicing speed without the need for slowing or stopping the initially moving web, the present invention employs a vacuum assembly which holds, pulls, and gradually accelerates the initially stationary web. The vacuum assembly preferably includes a first series of vacuum belts positioned to run around a series of pulleys. Within each vacuum belt is a at least one vacuum box. A vacuum is created within each vacuum box by a vacuum blower connected thereto. Each vacuum box preferably has an open face running behind a length of the corresponding vacuum belt's path. A number of holes in a length of each vacuum belt preferably pass across the open face of the underlying vacuum boxes as the belts runs their paths, thereby temporarily creating suction through the holes which acts to hold web material to the first series of vacuum belts.

The tail of the initially stationary web is first placed over the vacuum belt holes, which are themselves initially positioned over the open faces of the vacuum boxes at their top ends. To ensure precise and controlled positioning of the vacuum belts (as well as to determine their speed), the vacuum belts are preferably toothed timing belts. The suction created through the holes by rile vacuum within the vacuum boxes holds the tail of the initially stationary web to the vacuum belts. When the splicing operation is begun, a belt motor turns the vacuum belts, which pulls the attached initially stationary web along a length of the vacuum belt path. The length over which the accelerating web is held allows for a gradual web acceleration and prevents web rupture.

A second series of vacuum belts and a corresponding second vacuum assembly preferably faces the first series of vacuum belts and corresponding first vacuum assembly. The second series of vacuum belts and corresponding second vacuum assembly is substantially the same in structure and operation as the first series of vacuum belts. To eliminate the need for web taping or web adhesive in the splicing operation, a pressure bonding mechanism is preferably located at the bottom portions of both the first and the second series of vacuum belts. Preferably, the pressure bonding mechanism is a series of ply-bond wheels attached for rotation at the bottom portions of the belts. Both series of vacuum belts and corresponding vacuum belt assemblies are preferably mounted to rotate about a top portion of the respective vacuum belts, thereby bringing the ply-bond wheels at the bottoms of both series of vacuum belts together. By the time the initially stationary web has been pulled by the first vacuum belts to the bottom of the path traveled by the belts, the bottoms of both series of vacuum belts have preferably been pushed or pulled together by one or more actuators. By this same time, the initially stationary web held to the first series of vacuum belts has reached the speed of the initially moving web, and can reliably be spliced to the initially moving web by passing both webs through the ply-bond wheels. As the holes holding the initially stationary web to the first series of vacuum belts reach the bottom of the path followed by the first series of vacuum belts, the holes pass from the open front face of the vacuum boxes, thereby releasing the initially stationary web to the adjacent ply-bond wheels. For more precise bonding, a primary actuator is preferably employed to move the bottoms of both series of vacuum belts and ply-bond wheels to a close position with respect to one another, while a series of fast secondary actuators are employed to push the ply-bond wheels together when the web sections to be spliced are reached. When the web sections to be spliced have passed through the ply-bond wheels, the secondary actuators and the primary actuator are retracted. Preferably at a time just prior to this, a cutting blade is actuated to sever the initially moving web near the top of the second series of vacuum belts. At this time, the holes within the second series of vacuum belts are located at the top of the second series of vacuum belts and hold the trailing end of the severed web as it proceeds down the second series of vacuum belts and between the ply-bond rolls.

To further assist the initially stationary web to come up to the speed of the initially moving web without rupturing, an idler roll immediately upstream of the first series of vacuum belts is preferably driven temporarily by a motor through a clutch. By driving the idler roll in this manner, the initially stationary web is not required to overcome the rotational inertia of the idler roll.

Typically, the two webs to be spliced are unwound from parent rolls which have high inertias. Therefore, the apparatus and method of the present invention preferably includes a dancer roll and substantially vertical dancer track located between each parent roll and the corresponding vacuum belts. Each dancer roll is preferably slidable within its associated dancer roll track, and has one of the two webs of material passed therearound. By moving the dancer roll up or down within the dancer roll track, the amount of material being passed to and from the dancer roll preferably increases and decreases, respectively. Dancer roll sensors are preferably used to detect the location of each dancer roll within its dancer roll track, and preferably provide this information to a controller which controls the rotational speed of the parent rolls. In this manner, excess web material can be accumulated by a dancer roll just prior to the acceleration of an initially stationary web and can be controllably released as the parent rolls driven up to splicing speed. This allows the end of the initially stationary web to quickly accelerate as described above while providing the slower parent roll enough time to come up to splicing speed. Similarly, at the end of the splicing process when one parent roll is decelerating, the dancer roll can be moved to take up the web unwinding during parent roll deceleration.

More information and a better understanding of the present invention can be achieved by reference to the following drawings and detailed description.

BRIEF DESCRIPTION OF THE DRAWINGS

The present invention is further described with reference to the accompanying drawings, which show preferred embodiments of the present invention. However, it should be noted that the invention as disclosed in the accompanying drawings is illustrated by way of example only. The various elements and combinations of elements described below and illustrated in the drawings can be arranged and organized differently to result in embodiments which are still within the spirit and scope of the present invention.

In the drawings, wherein like reference numerals indicate like parts.

DETAILED DESCRIPTION OF PREFERRED EMBODIMENTS

A) Structure of the First Preferred Embodiment

Figure 1:
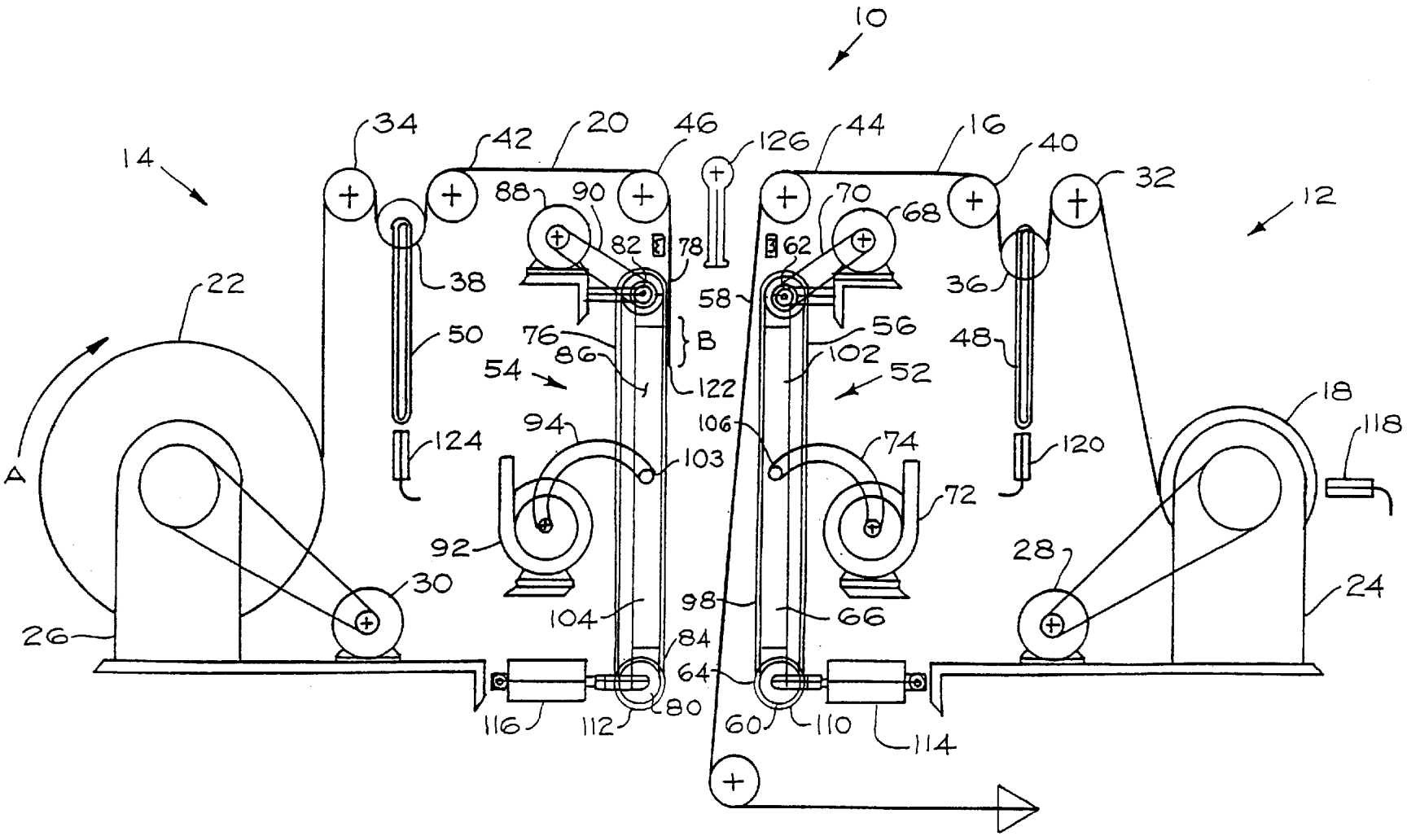
FIG. 1 is a sectional view of a first preferred embodiment of the splicer apparatus according to the present invention at a first stage of the apparatus's operation.

A first preferred embodiment of the present invention is shown in FIGS. 1–8. With reference first to FIG. 1, the splicer apparatus of the present invention (designated generally at 10) preferably includes two substantially identical splicer assemblies 12 and 14. In FIG. 1, one web of material 16 is shown running from a parent roll 18 through the splicer assembly 12 and out to downstream machinery (not shown), while another web of material 20 is shown in a stationary position leading from parent roll 22 into the splicer assembly 14 where it terminates. FIGS. 1–5 illustrate the case where one parent roll 18 being unwound is almost depleted, and a fresh parent roll 22 is ready to be spliced onto the web 16 of the parent roll 18. Of course, the operations shown in the figures can be performed at times which are different from the particular instance shown. For example, the almost depleted roll can instead be the parent roll 22, while the fresh roll can be the parent roll 18. Also, the splicing operations according to the present invention need not necessarily be performed when one parent roll is almost depleted and the other is fresh. As long as there is sufficient web material on both webs to complete the splicing operation described in more detail below, the splicing operation can be performed at any time.

With particular reference to FIG. 1, the parent rolls 18 and 22 are both mounted for rotation in a conventional manner upon roll mounts 24 and 26, respectively, and are driven by motors 28 and 30 also in a conventional manner. The webs 16 and 20 extending from each of parent rolls 18 and 22, respectively, run up to and over idler rolls 32 and 34, under dancer rolls 36 and 38, over idler rolls 40 and 42, and then over idler rolls 44 and 46, respectively. Each idler roll 32, 34, 40, 42, 44 and 46, is positioned and secured for rotation in a conventional manner. Dancer rolls 36 and 38 are preferably supported by their ends within substantially vertical tracks 48 and 50, respectively, which are themselves supported in place and permit upward and downward movement of dancer rolls 36 and 38 in a conventional fashion within vertical tracks 48 and 50.

The splicer assemblies 12 and 14 are each provided with a vacuum assembly, (indicated generally at 52 and 54, respectively). Vacuum assembly 52 preferably has the following components (only one of each which are shown in the Figures): a series of vacuum belts 56 running around a series of upper pulleys 58 and lower pulleys 60 which are mounted on a respective upper shaft 62 and lower shaft 64; a series of vacuum boxes 66—one box supported within and underlying each vacuum belt 56; a belt motor 68 rotatably driving upper shaft 62 via a drive belt 70; and a vacuum blower 72 connected to each vacuum box 66 via vacuum hoses 74. Vacuum assembly 54 similarly preferably comprises substantially identical components (i.e., a series of vacuum belts 76, upper pulleys 78, and lower pulleys 80, an upper shaft 82, a lower shaft 84, a series of vacuum boxes 86, a belt motor 88, a drive belt 90, a vacuum blower 92, and a series of vacuum hoses 94) arranged and connected in a fashion similar to the corresponding components in the vacuum assembly 52.

Figure 6:
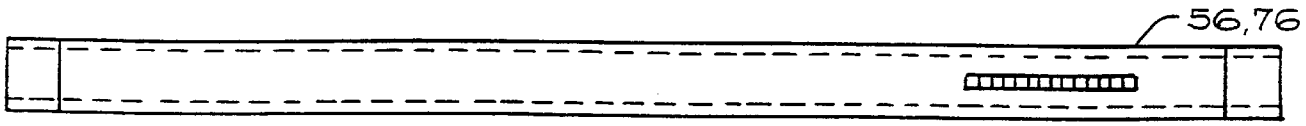
FIG. 6 is a top view of the vacuum belt of the present invention.
Figure 7:
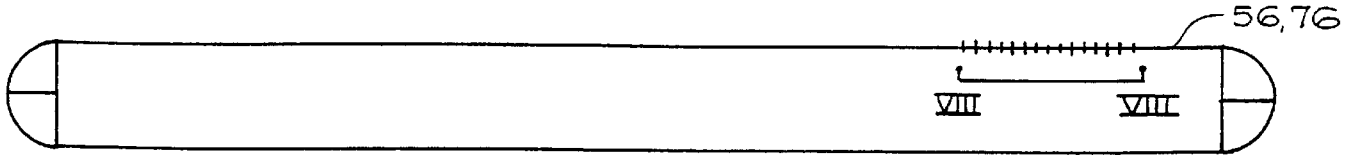
FIG. 7 is a side view of the vacuum belt shown in FIG. 6.
Figure 8:
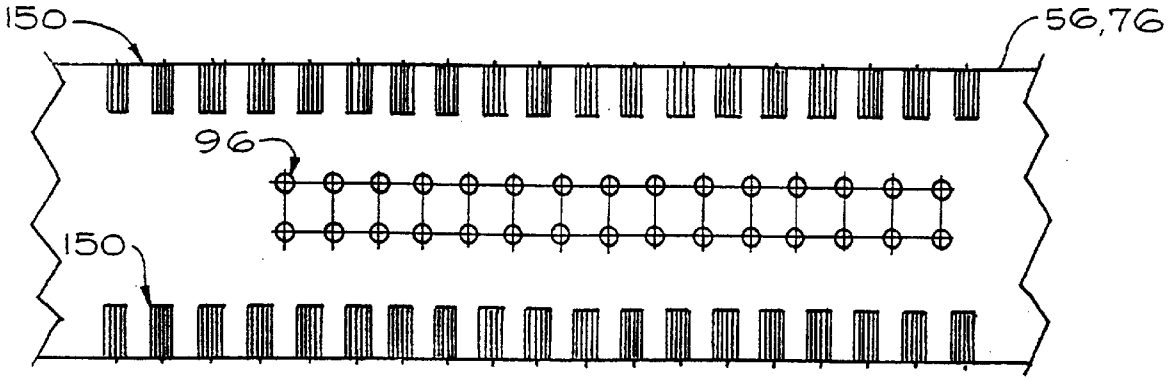
FIG. 8 is a sectionalized view of a portion of the vacuum belt shown in FIGS. 6 and 7, taken along section VIII—VIII of FIG. 7 and showing the vacuum holes of the vacuum belt.

Each vacuum belt 56, 76 is preferably made of a wear-resistant material such as polyurethane, engineered plastic, etc., and is preferably provided with a series of holes 96 through a section of its length (see FIGS. 6–8). By virtue of its mounting arrangement over the upper and lower pulleys 58, 78 and 60, 80, respectively, a space exists between the facing lengths of each vacuum belt 56, 76. Within this space is located a vacuum box 66, 86 as indicated above. Each vacuum box 66, 86 preferably comprises an elongated channel-shaped element having closed ends and a open front face 98, 100. The open front face 98, 100 of each vacuum box 66, 86 is positioned to directly underlie the underside of each corresponding belt as shown in FIG. 1. Each vacuum box 66, 86 therefore has defined within its walls and the overlying vacuum belt 56, 76 a vacuum chamber 102, 104, respectively. To ensure a better seal between the sides of each vacuum box 66, 86 and each corresponding vacuum belt 56, 76, an elastomer seal (not shown) can be attached to and run around the open front faces 98, 100 of each vacuum box 66, 86. Therefore, as the vacuum belts 56, 76 run across the open front faces 98, 100 of the vacuum boxes 66, 86 (described in more detail below), the vacuum chambers 102, 104 in each vacuum box 66, 86 are substantially sealed. Each vacuum box 66, 86 is connected via the series of vacuum hoses 74, 94 (preferably, one vacuum hose per vacuum box) to the corresponding vacuum blowers 72, 92 in a conventional fashion. Specifically, each vacuum box 66, 86 is provided with an opening 106, 108 over which the vacuum hoses 74, 94 are attached, respectively. This attachment permits the vacuum blowers 72, 92 (when activated) to evacuate air from vacuum boxes 66, 86, thereby creating a vacuum within each vacuum box 66, 86. The vacuum created helps to maintain a seal between each vacuum belt 56, 76 and the respective vacuum boxes 66, 86. Preferably, the vacuum hoses 74, 94 are made of a flexible material to permit movement of the vacuum boxes 66, 86 with respect to the vacuum blowers 72, 92 as required (discussed below). Such vacuum hoses and their various materials are well known to those skilled in the art, and are therefore not described further herein.

The belt motors 68 and 88 preferably turn the drive belts 70 and 90, respectively, which themselves rotate the upper shafts 62 and 82 and the upper pulleys 58 and 78 mounted thereon, respectively. The rotation of the upper pulleys 58 and 78 therefore turns the vacuum belts 56 and 76 in a manner well known to those skilled in the art. As will be described in greater detail below, the vacuum created within the vacuum boxes 66, 86 by the vacuum blowers 72, 92 causes a suction effect on the outer surface of the vacuum belts 56, 76 around the vacuum belt holes 96. This suction pulls nearby web material firmly against the outer surface of the vacuum belts 56, 76 and permits the web material to be drawn along the length of the vacuum boxes 66, 86 as the belt motors 68, 88 turn the vacuum belts 56, 76.

A ply-bond wheel 110 is preferably mounted for rotation between each of the series of vacuum belts 56 and corresponding lower pulleys 60 on the splicer assembly 12. Similarly, a ply-bond wheel 112 is preferably mounted for rotation between each of the series of vacuum belts 76 and corresponding lower pulleys 80 on the splicer assembly 14. At least one of the ply-bond wheels 110, 112 are preferably provided with a rough outer surface (e.g., a dimpled, knurled, or ribbed surface) which can be patterned to mesh with the ply-bond wheels 112, 110 on the facing splicer assembly 12, 14. Alternately, the ply-bond wheels 110, 112, can mesh with smooth ply-bond wheels 110, 112, on the facing splicer assembly 12, 14.

Actuators 114 and 116 are attached to the lower shafts 64 and 84 of the splicer assemblies 12 and 14. The actuators 114 and 116 can be of any type well known to those skilled in the art, such as hydraulic or air cylinder actuators, electromagnetic actuators, etc. The actuators 114 and 116 are also attached to a fixed point relative to the respective splicer assemblies 12 and 14, and therefore can be actuated to pull or push the lower shafts 64, 84 of each splicer assembly 12, 14 to pivot the vacuum belts 56, 76 and vacuum boxes 66, 86 about the upper shafts 58 and 78, respectively. This pivoting action acts to bring the ply-bond wheels 110 and 112 together when the actuators 114, 116 are extended (as noted below with respect to the operation of the present invention).

B) Operation of the First Preferred Embodiment

A sequence of operational stages for the first preferred embodiment of the present invention is illustrated in FIGS. 1–6. With reference first to FIG. 1, the webs 16 and 20 of the parent rolls 18 and 22, respectively, are shown running through the idler rolls 32, 34, 40, 42, 44, 46 and the dancer rolls 36 and 38 as described above. The web 16 of the parent roll 18 is shown being run at normal operational speed from the parent roll 18 through the splicer apparatus 10 (between splicer assemblies 12 and 14) and to one or more pieces of downstream equipment (not shown). In this stage, the splicer apparatus 10 is essentially inactive, with the belt motors 68, 88, the vacuum belts 56, 76, the vacuum blowers 72, 92, and the actuators 114, 116 being stationary. As the parent roll 18 is gradually depleted, a sensor 118 preferably monitors the size of the parent roll 18. Simultaneously, during this stage, a dancer roll sensor 120 preferably monitors the location of the dancer roll 36 in the vertical track 48. The position of the dancer roll 36 in the vertical track 48 is communicated to a controller (not shown) which is also in communication with and preferably independently controls the powered state and/or the speed of motors 28, 30, the actuators 114, 116, the vacuum blowers 72, 92, and the belt motors 68, 88. During the operational stage shown in FIG. 1, if the unwind speed of the parent roll 18 should increase beyond the speed of the web 16 in operations downstream of the splicer apparatus 10, the extra slack within the splicer assembly 12 is taken up by a downward motion of the dancer roll 36 in the vertical track 48 until the motor 28 controlled by the controller has sufficient time to reduce the speed of the parent roll 18. Similarly, if the unwind speed of the parent roll 18 should decrease below the speed of the web 16 in operations downstream of the splicer apparatus 10, the excess tension exerted on the web 16 can be relieved by an upward motion of the dancer roll 36 in the vertical track 48 until the motor 28 controlled by the controller has sufficient time to increase the speed of the parent roll 18. Because a light tension is desirable and slack in the web 16 is undesirable as discussed in the Background of the Invention above, the dancer roll 36 is preferably kept in a location near the top of the vertical track 48 during the stage shown in FIG. 1. The operations just described to control the speed of the motor 28 by monitoring the amount of web 16 in the splicer assembly 12 via the position of the dancer roll 36 are well known to those skilled in the art and are not therefore discussed further herein.

When the parent roll 18 is reduced to a desired size (which can correspond, for example, to an almost-depleted state of parent roll 18, a known break in the parent roll 18, a desired amount of unwound web 16, or a desired parent roll size), the sensor 118 preferably sends a signal to the controller to begin the splicing process. In the event that the end 122 of the web 20 from the fresh roll is ragged or damaged, the end may be cut off prior to this time in any convention manner well known to those skilled in the art. For example, a well known method of removing the uneven or ripped end of a roll is to manually cut across the width of the web with a roller having a V-shaped cross-section. The roller (not shown) presses the web to be cut against a long blade mounted along the width of the web (also not shown), thereby cutting the ragged web off to be discarded. Other manners in which the end of a web may be cut off and tools to accomplish this task are well known to those skilled in the art and fall within the spirit and scope of the present invention.

In the first step of the splicing process, the controller preferably determines the speed of the web 16 in the splicer assembly 12 (e.g., via sensor 118 or by other means well known to those skilled in the art). If necessary, and at the preference of the operator, the controller can send a signal to both the motor 28 turning the parent roll 18 and to the equipment downstream of the splicer apparatus 10 to slow the web 16 in a conventional manner to a desired splicing speed.

Second, the controller preferably sends a signal to turn on the vacuum blower 92 and another signal to the motor 30 to slowly turn the fresh parent roll 22 in a direction indicated by arrow A on FIG. 1. In the operational stage shown in FIG. 1, the holes 96 of the vacuum belt 76 are located in the upper position indicated by bracketed area B on FIG. 1. By turning the vacuum blower 92 on, the end 122 of the web 20 on the fresh parent roll 22 is secured by suction to a top area of the vacuum belt 76. Therefore, when the motor 30 turns the fresh parent roll 22 in the direction indicated by arrow A on FIG. 1, any slack existing between the fresh parent roll 22 and the end 122 of the web 20 is wound up onto the fresh parent roll 22. Also by this rotation, the web 20 elevates the dancer roll 38 to a top-most position in vertical track 50. A dancer roll sensor 124 (similar to the dancer roll sensor 120 in the neighboring splicer assembly 12) preferably monitors the movement of the dancer roll 38 and sends a signal to the controller to indicate when the dancer roll 38 has reached the top-most position in the vertical track 50, at which time the controller preferably sends a signal to the motor 30 to stop its rotation. Therefore, at the operational stage shown in FIG. 1, the web 20 of the fresh parent roll 22 is ready for the splicing operation.

It should be noted that the dancer rolls 36 and 38 in the present invention can be free-floating within vertical tracks 48 and 50, respectively, thereby being fully vertically supported within the tracks by the webs 16 and 20. However, it is preferred that the vertical tracks 48 and 50 provide a counterweight to the dancer rolls 36 and 38 to counter at least a portion of the dancer rolls' weight. Roll counterweight systems and methods are well known to those skilled in the art, and are therefore not described in further detail herein. Also, the vertical position of the dancer rolls 36 and 38 in their respective vertical tracks 48 and 50 can be indexed and maintained as desired in a number of conventional manners. Therefore, for those operations described herein in which the location of the dancer rolls 36 and 38 are changed in order to take up or release web material, it should be noted that the positions of the dancer rolls 36 and 38 can be directly controlled by a controller. Such roll indexing systems are well known to those skilled in the art, and are therefore not described in further detail herein.

Figure 2:
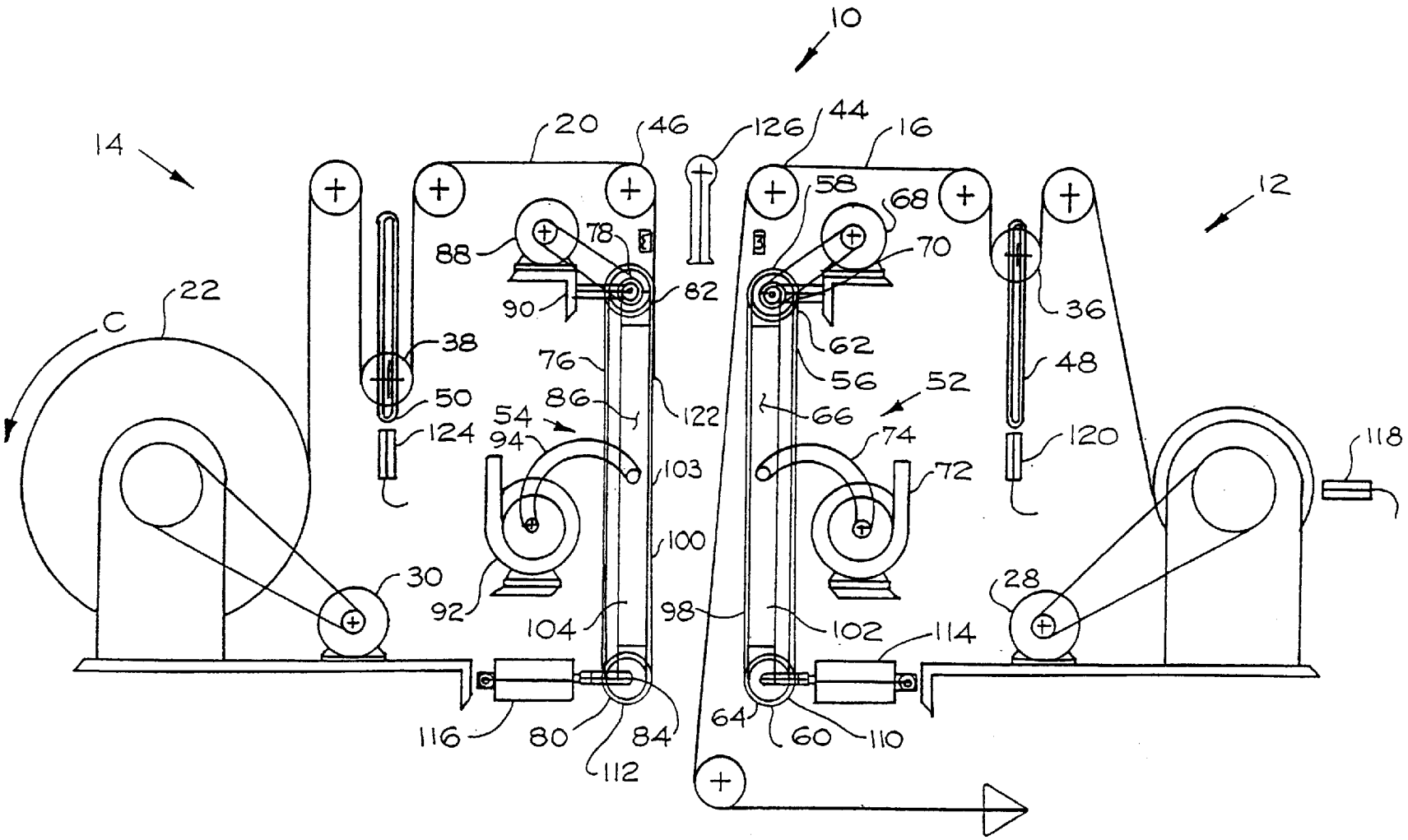
FIG. 2 is a sectional view of the apparatus shown in FIG. 1, with the apparatus in a second stage of the operation.

Next, the controller preferably sends a signal to the motor 30 to begin accelerating and rotating the fresh parent roll 22 in a direction indicated by arrow C on FIG. 2. This motion creates slack in the web 20 which is taken up by the dancer roll 38 by being dropped to a lower position in the vertical track 50. When the dancer roll sensor 124 detects that the dancer roll 38 has reached a low position within the vertical track 50, the dancer roll sensor 124 preferably sends a signal to the controller to indicate this position has been reached. The controller then preferably sends a signal to the belt motor 88 to begin turning the upper shaft 82 and the vacuum belts 76. The belt motor 88 accelerates quickly, and therefore quickly increases the speed of the vacuum belts 76 and the web 20 attached by suction action thereto. However, the speed of the vacuum belts 76 is gradually ramped over the entire vertical distance of the vacuum belts 76, thereby providing for a relatively low tension force on the web 20 during the accelerating period. This gradual acceleration exerts less tensile force on the web 20 than instantaneous or short acceleration periods (which produce significant tension spikes during web acceleration). In order to further reduce the tension experienced by the web 20 during the acceleration on the vacuum belts 76, the idler roll 46 (and the corresponding idler roil 44 on the opposite splicer assembly 12) is preferably driven by a motor through a clutch (not shown) which is engaged in a conventional manner by the controller at a time close to when the controller sends the signal to the belt motor 88 to begin turning the upper shaft 82. The motor-driven idler roll 46 begins to turn and assists the movement of the web 20 over the idler roll 46, rather than requiring the web 20 to overcome the rotational inertia of the stationary idler roll 46 when coming up to speed. By assisting the web 20 to move in this manner, the clutch and motor-driven idler roll 46 helps to prevent excess tension on the web 20 during splicing operations. After the web 20 comes up to speed as described below, the clutch on the idler roll 46 preferably disengages to leave the idler roll 46 once again unpowered.

Figure 3:
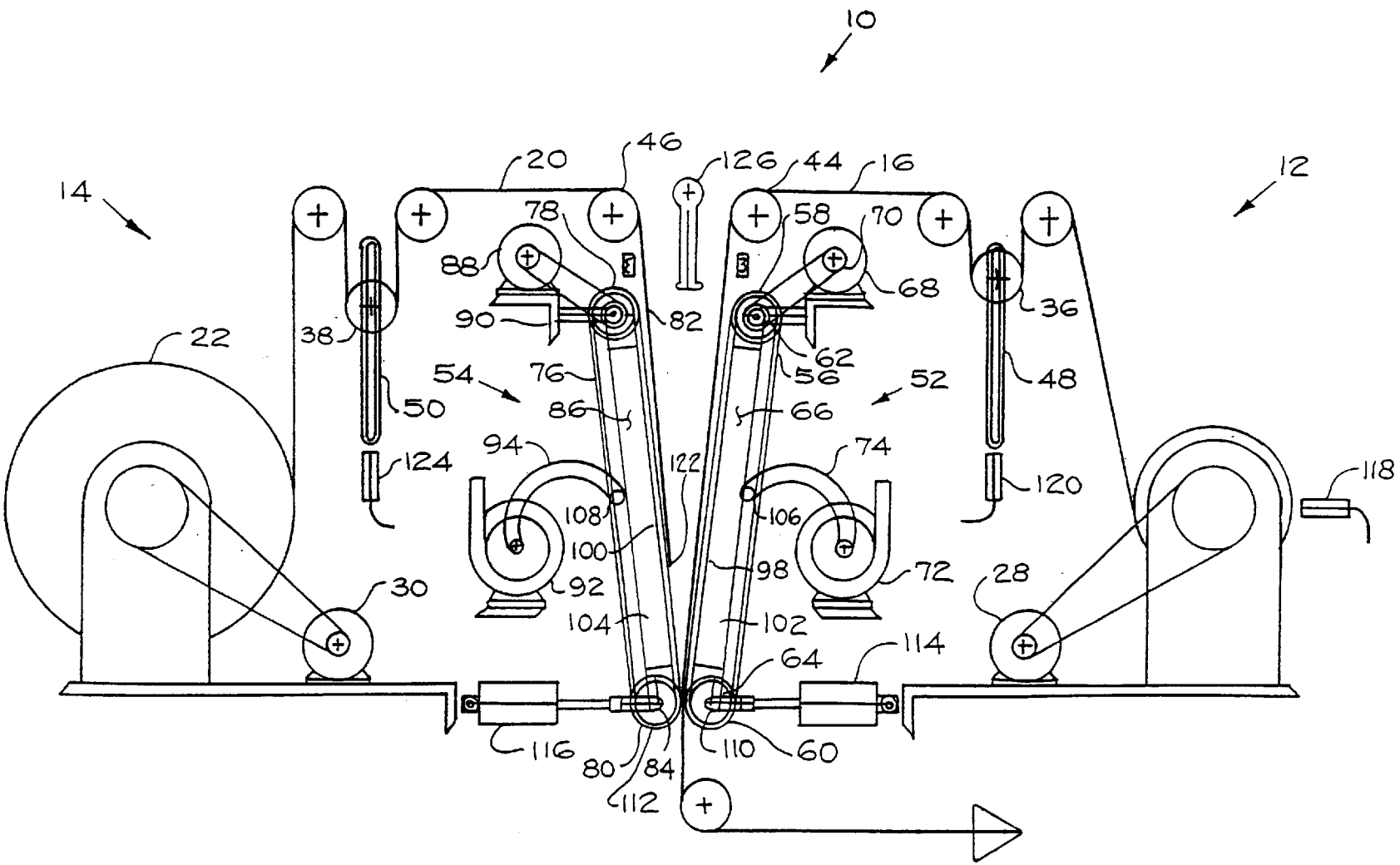
FIG. 3 is a sectional view of the apparatus shown in FIG. 1, with the apparatus in a third stage of operation.

As shown in FIG. 3, the web 20 from the fresh parent roll 22 is accelerated and dragged down the vertical length of the vacuum belts 76. By the time the end 122 of the web 20 has reached the bottom of the vacuum belts 76, the speed of web end 122 matches the speed of the running web 16, the speed of both webs 16 and 20 near the vacuum belts 56, 76 being measured in a manner described below. To provide the fresh parent roll 22 enough time to also accelerate to the speed of web end 122, the excess of the fresh web 16 earlier taken up by the dancer roll 38 in the vertical track 50 is released. This release can be performed by a lifting action exerted by the fresh web 20 upon the dancer roll 38, which itself is caused by increased tensile force exerted upon the fresh web 20 in the acceleration of web end 122. Alternatively, the release can be controlled primarily by a controller for the dancer roll as is known in the art. The web 20 released by the dancer roll 38 during the operational stage shown in FIG. 3 permits the parent roll 22 to come up to speed with the end 122 of the web 20.

With continued reference to FIG. 3, at or at some time near when the belt motor 88 is instructed by the controller to begin turning, a signal is sent to the actuators 114 and 116 to extend to a position where the ply-bond wheels 110 and 112 are in contact with one another. Therefore, by the time the web end 122 of the fresh web 20 reaches the bottom of the vacuum belts 76, the web end 122 has reached the web speed of web 16, and the ply-bond wheels 110, 112 are in position to bond webs 16 and 20 together. Specifically, the actuators 114 and 116 exert a sufficient force compressing the ply-bond wheels 110, 112 together to bond the webs 16 and 20 which pass through the nip position between the ply-bond wheels 110 and 112. It should be noted that because the nip position between the ply-bond wheels 110 and 112 is below the front open face 100 of the vacuum box 86, the suction exerted through the holes 96 by the vacuum within the vacuum box 86 ceases by the time the web end 122 reaches the nip position, thereby releasing the web 16 from the vacuum belts 76. In an alternative embodiment, the vacuum box 86 can extend to the nip and the vacuum can be shut off when desired.

It should be noted that other assemblies and methods (rather than ply-bond wheels 110, 112) can be used to bond the web 16, 20 together. For example, the ply-bond wheels 110, 112 can be replaced by two large pressure bonding rolls (not shown) positioned directly beneath the nip position of the vacuum belts 56, 76. Alternately, continuous tracks can be similarly positioned to press the two webs 16, 20 together against a roll, another track, or any number of other surfaces to effectuate a pressed bond between the two webs 16, 20. Also, two movable plates (also not shown) can be positioned immediately downstream of the vacuum belts 56, 76 to press and bond a section of the webs 16, 20 together. Alternate pressure-bonding systems and methods are well known to those skilled in the art and fall within the spirit and scope of the present invention.

By accurately measuring the speed of the web 16 just prior to the splicing operation and by measuring the speed to which the web 20 is ramped during the splicing operation, the speed of both webs 16 and 20 can be synchronized for precise splicing (by, for example, adjusting the speed of the belt motor 88 turning the vacuum belts 76). The speed of both webs 16 and 20 can be measured in a number of different ways. In the preferred embodiment of the present invention shown in the figures, each vacuum belt 56, 76 is preferably provided with timing teeth 150 along the edges of each vacuum belt 56, 76 (see FIG. 8). These timing teeth 150 are preferably detected, counted and timed by a conventional timing belt sensor (not shown) to determine the exact position of each vacuum belt 56, 76 as well as the speed of each vacuum belt. Other methods for detecting the position and speed of the vacuum belts 56, 76 can also be employed, such as by measuring the number of rotations of upper shafts 62, 82 and/or the lower shafts 64, 84 via a conventional sensor, by securing one or more speed sensors near the vacuum belts 56, 76 to directly measure the surface speed of the vacuum belts in a conventional manner, etc. These alternate methods for detecting the position and speed of the vacuum belts 56, 76 are well known to those skilled in the art and are therefore not described further herein.

Figure 4:
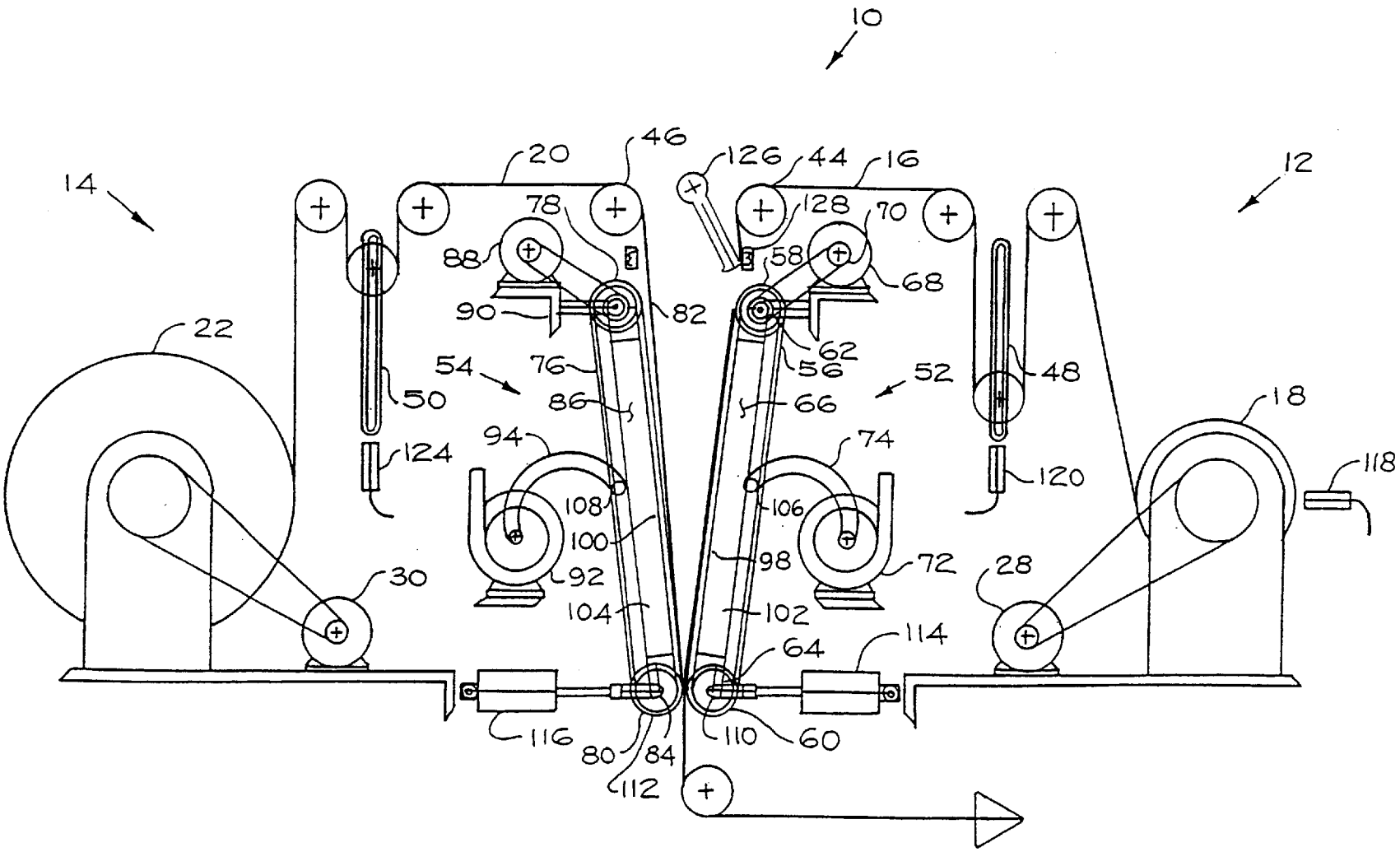
FIG. 4 is a sectional view of the apparatus shown in FIG. 1, with the apparatus in a fourth stage of operation.
Figure 5:
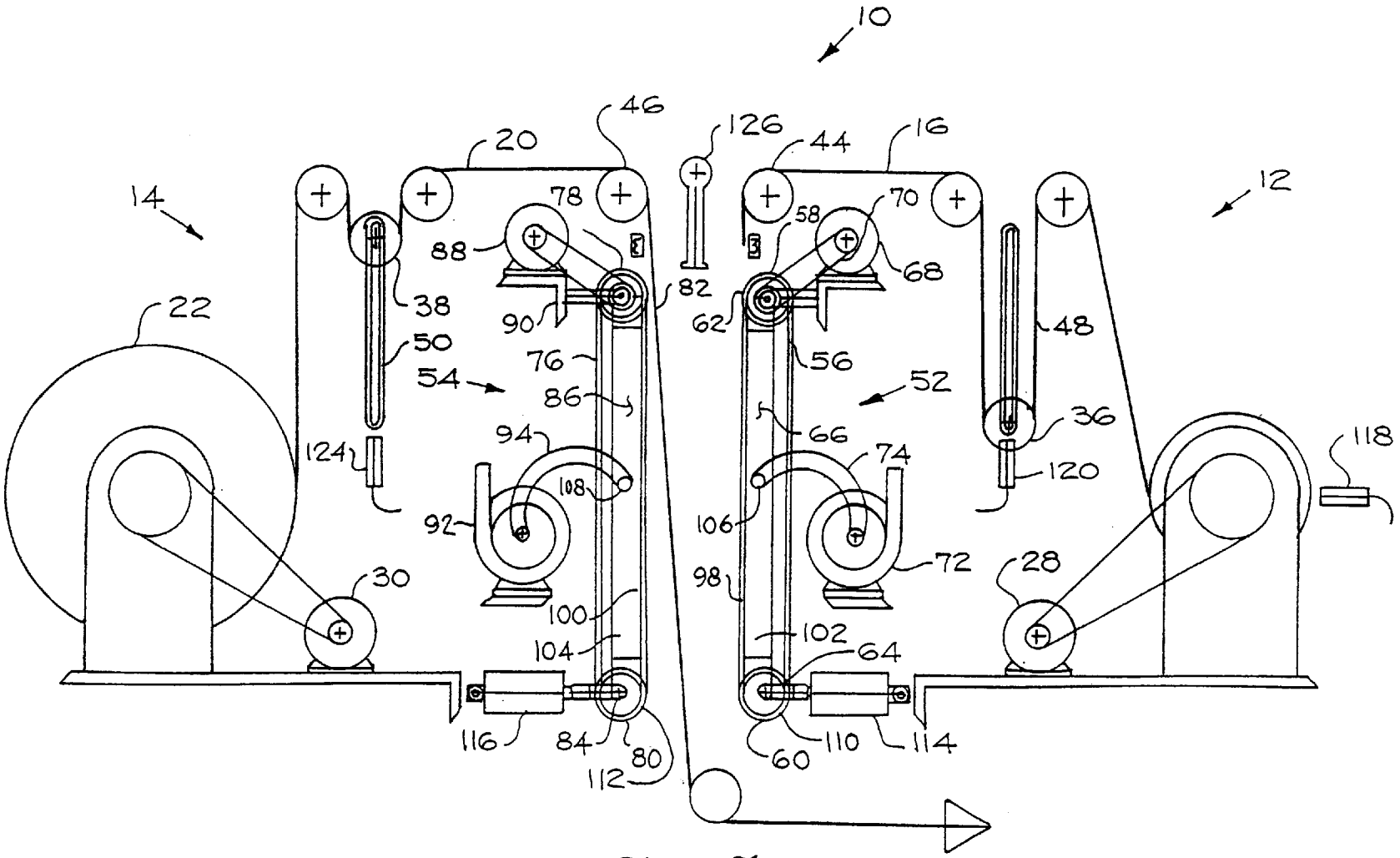
FIG. 5 is a sectional view of the apparatus shown in FIG. 1, with the apparatus in a fifth stage of operation.

In the next operational stage of the present invention illustrated in FIG. 4, the vacuum belts 76 continue to run around the upper pulleys 78 and the lower pulleys 80, thereby moving the vacuum holes 96 in the vacuum belts 76 up the backside of the vacuum boxes 86. Tis position of the vacuum belts 76 is detected by the timing belt sensor (not shown) as described above, which sends a signal at this time to turn the vacuum blower 92 on the fresh web side off and to turn the vacuum blower 72 on the depleted web side on. By turning the vacuum blower 92 off at this time, the fresh web 20 is prevented from attaching to the vacuum belt 76 once the holes 96 in the vacuum belts 76 again move into a location facing the web 20. By turning the other vacuum blower 72 on at this time, after the web 16 of the depleted parent roll 18 has been severed (described below), the trailing end of the depleted parent roll 18 is held in place against the vacuum belts 56 by the suction created through the holes 96 in the vacuum belts 56. This securement is performed once the holes 96 in the vacuum belts 56 are rotated to an upper position on the open front faces 98 of the vacuum boxes 66. When this position is reached by the holes 96 in the vacuum belts 76 (once again measured by the timing belt sensor described above), a signal is preferably sent front the controller to a cutter 126 which is preferably rotatably secured at a location above and between the upper shafts 62, 82. This signal causes the cutter to rotate and push the web 16 against a blade 128 located on the opposite side of the web 16, thereby cutting the web 16 at this point. At this operational stage, a signal is also sent by the controller to the motor 28 to decelerate and stop the depleted parent roll 18. Due to the fact that such a stop is not instantaneous, web material which continues to unwind from the depleted parent roll 18 after the web 16 has been cut is taken up by the dancer roll 36 as it is moved down along the track 48 under the weight of the dancer roll 36.

It should be noted that though preferred, the process of securing the trailing end of the depleted parent roll 18 to the vacuum belt 56 is not required to practice the present invention. Specifically, the tail securement process just described can be left unperformed, with the trailing end of the depleted parent roll 18 being drawn between the ply-bond wheels 110, 112. In this case, the vacuum belt 56 acts only to support the trailing end of the depleted parent roll 18 as is drawn between the ply-bond wheels 110, 112.

In the final stage of the web splicing operation (see FIGS. 4 and 5), the fresh web 20 is continued to be drawn between the two splicer assemblies 12, 14 while the severed tail end of the depleted roll web 16 is drawn down between the ply-bond wheels 110 and 112 to be bonded to the fresh web 20. After the tail end of the depleted roll web 16 has been bonded and has left the nip position between the ply-bond wheels 110 and 112 (this being preferably determined by the position of the vacuum belts 56, 76 in the manner described above), a signal is sent by the controller to the actuators 114 and 116 to retract, thereby pulling the lower shafts 64, 84 and the ply-bond wheels 110, 112 to their original spread positions (see FIG. 5). Also, the controller sends a signal to the vacuum blower 72 to turn the vacuum blower 72 off. Finally, the vacuum belts 56 and 76 are rotated to their original positions where the holes 96 in each vacuum belt set 56, 76 are positioned near the tops of the underlying vacuum boxes 66, 86, respectively. Once again, the position of the vacuum belts 56, 76 is preferably detected by the timing belt sensors described above.

If necessary, the web speed of the fresh web 20 and the web 20 downstream of the splicer apparatus 10 can be brought up to speed in a conventional manner by the controller. The splicer apparatus 10 is now ready for the next splicing operation, which follows the same steps and operations as described above, but for corresponding elements and assenblies on the opposing splicer assembly 14, 12.

Structure and Operation of the Second Preferred Embodiment

Figure 10:
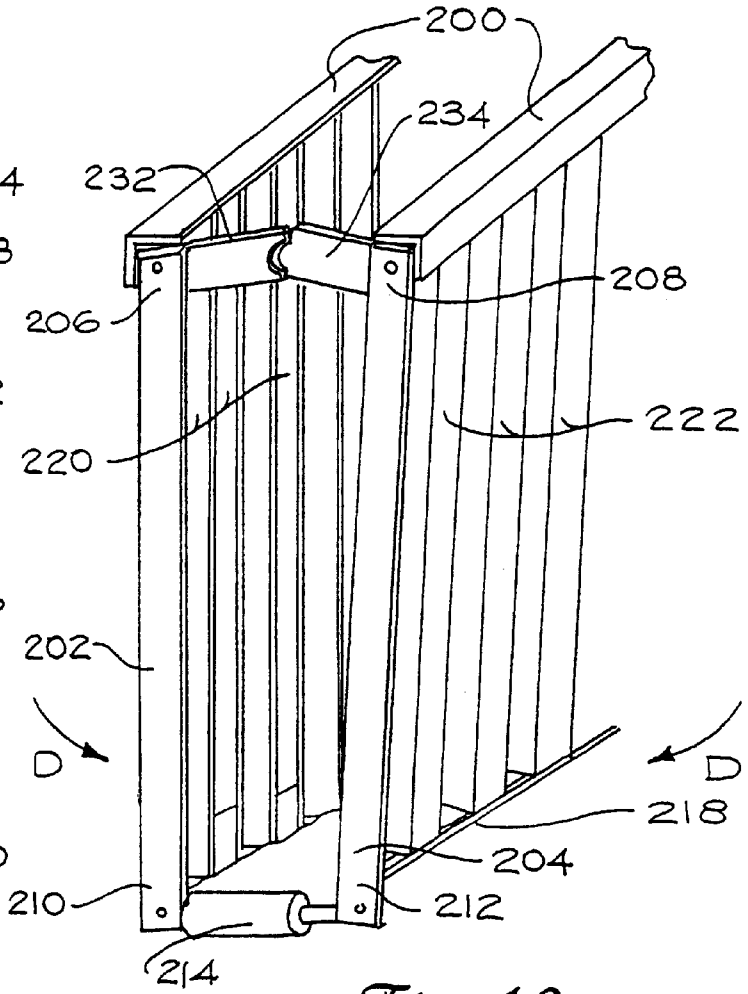
FIG. 10 is another perspective view of a portion of the splicer apparatus according to the second preferred embodiment of the present invention.
Figure 9:
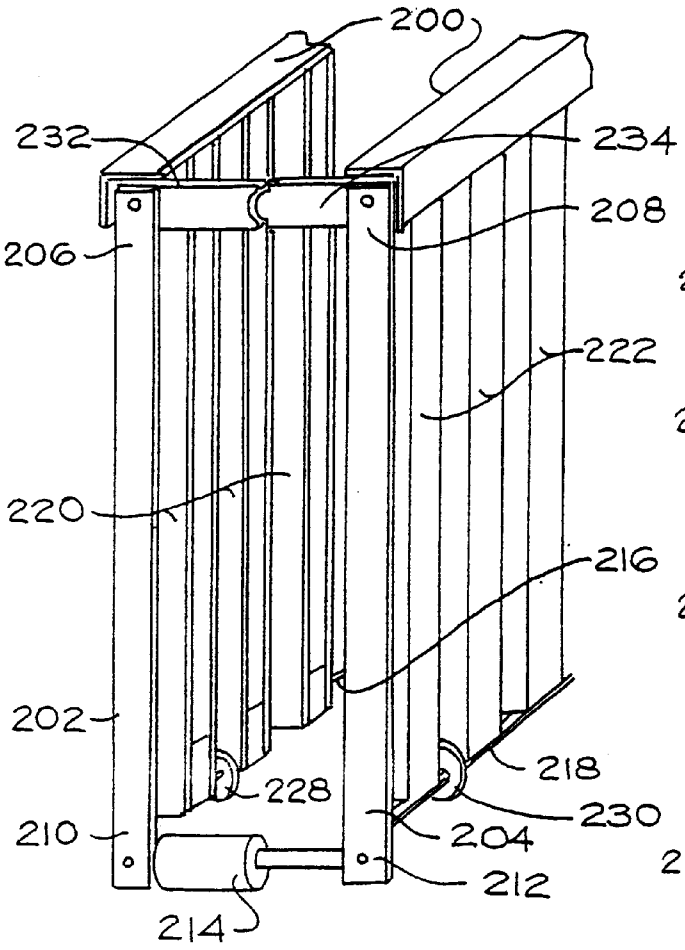
FIG. 9 is a perspective view of a portion of the splicer apparatus according to a second preferred embodiment of the present invention.

A second preferred embodiment of the present invention is illustrated in FIGS. 9 and 10. The splicer apparatus of the present invention according to the second preferred embodiment differs from the first preferred embodiment primarily in the elements, arrangement and operation of the vacuum assemblies (52 and 54 in the first preferred embodiment) and the actuators (114 and 116 in the first preferred embodiment). As seen in FIGS. 9 and 10, the upper shaft 62, 82, lower shaft 64, 84 and vacuum box 66, 86 arrangement of the first preferred embodiment is replaced by two swing arms 202, 204 which are mounted to rotate on a frame 200 about their upper ends 206, 208 and which are attached at their lower ends 210, 212 by one actuator 214. The actuator 214 is pivotably mounted on both ends in a conventional manner to lower ends 210, 212 of swing arms 202, 204. The lower end 210, 212 of each arm 202, 204 is attached in a conventional manner (e.g., by a connector bar 216, 218) to the lower ends of a series of vacuum boxes 220, 222 similar to the vacuum boxes 66,86 described above with regard to the first preferred embodiment. The upper ends of each series of vacuum boxes 220, 222 are pivotably attached in a conventional manner to the frame 200. As with the first preferred embodiment, vacuum belts 224, 226 (not shown for purposes of clarity in FIGS. 9 and 10) run around each vacuum box 220, 222, respectively, and operate in a manner much the same as the vacuum belts 56, 76 of the first preferred embodiment. Ply-bond wheels 228, 230 are rotatably mounted to the connector bars 216, 218 in a conventional fashion. For clarity purposes, only two of the ply-bond wheels 228, 230 are shown in FIG. 9 to illustrate the location and orientation of the ply-bond wheels 228, 230.

With the vacuum assemblies thus arranged, when the controller (not shown) sends a signal to bring the ply-bond wheels 228, 230 together as in the first preferred embodiment, preferably one actuator 214 draws the lower ends 210, 212 of the swing arms 202, 204 and the connector bars 216, 218 together as shown in FIGS. 9 and 10. The motion of swing arms 202, 204 and the vacuum boxes 220, 222 during this operation is indicated by the arrows labeled D in FIG. 10. Because the lower ends 210, 212 of the swing arms 202, 204 and the lower ends of each vacuum box 220, 222 are also attached to the connector bars 216, 218, respectively, the lower ends 210, 212 of the swing arms 202, 204 and the lower ends of the vacuum boxes 220, 222 also move together. To ensure that one swing arm 202, 204, connector bar 216, 218, and series of vacuum boxes 220, 222 do not swing more than the other swing arm 204, 202, connector bar 218, 216, and series of vacuum boxes 222, 220, the top of each swing arm 202, 204 is provided with an extension 232, 234. The two extensions 232, 234 meet in between the upper pivot points of the swing arms 204, 202. The extension 234 of one swing arm 204 has an end with a round profile. The extension 232 of the other swing arm 202 has an end with a C-shaped profile sized to accept the round profile of the mating extension 234. When the swing arms 202, 204 rotate, the round profile of the extension 234 pivots within the C-shaped profile of the mating extension 232, thereby maintaining an even movement of the swing arms 202, 204 (and the vacuum boxes 220, 222 and connector bars 216, 218) when the actuator 214 is operated to bring the ply-bond wheels 228, 230 together or to spread them apart.

It will be appreciated by one having ordinary skill in art that other interlocking configurations (e.g., other profile and extension shapes, locations and relationship of extensions, etc.) can be employed to ensure that each vacuum assembly moves an equal distance under the pull or push of actuator 214.

Structure and Operation of the Third Preferred Embodiment

Figure 11:
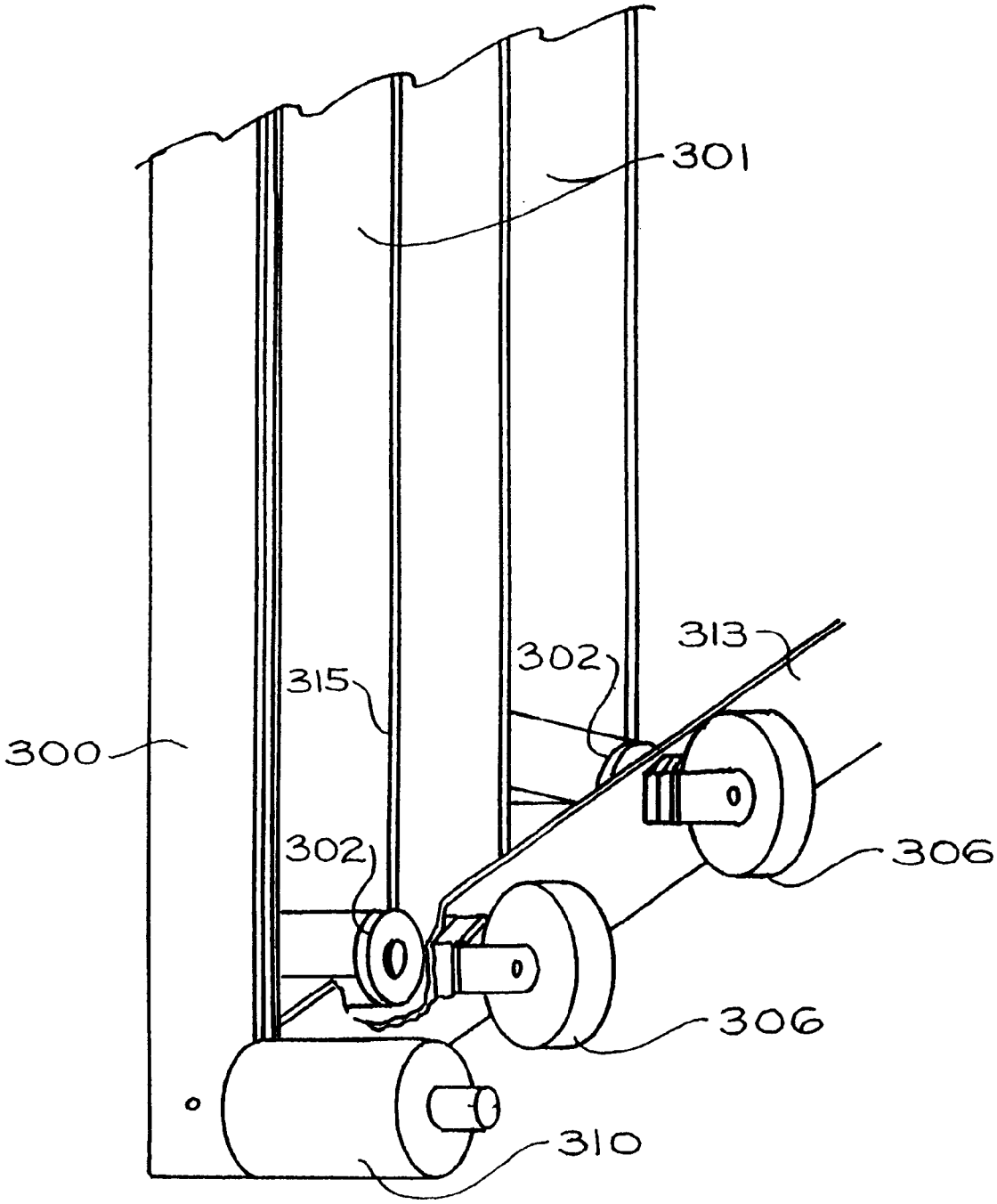
FIG. 11 is an enlarged view of a portion of the splicer apparatus according to a third preferred embodiment of the present invention.

A third preferred embodiment of the present invention is illustrated in FIG. 11, and differs from the second preferred embodiment described above and illustrated in FIGS. 9 and 10 in the addition of two batteries of secondary actuators 302 and 304 to the splicer apparatus. For purposes of clarity, only the left swing arm 300, and vacuum boxes 301 are shown in FIG. 11.

To increase the efficiency of the present invention, it is desirable to actuate the ply-bond wheels 306 for a very precise period of time. If the ply-bond wheels 306 are actuated for too long of a period of time, undesirable marks can be created by the ply-bond wheels 306 on web material outside of the sections of web material intended to be spliced. If the ply-bond wheels 306 are actuated for too short a period of time, splice quality can suffer, resulting in a poor or unsuccessful splice. Therefore, it is preferred to employ secondary actuators 302 in the splicer apparatus (in addition to a primary actuator 310 which is similar to the actuator 214 used in the second preferred embodiment). In the third preferred embodiment of the present invention illustrated in FIG. 11, the ply-bond wheels 306 are directly actuated by one or more secondary actuators 302. Specifically, each ply-bond wheel 306 is preferably mounted on a common bar 313 positioned adjacent the secondary actuators 302. One end of each of the secondary actuators 302 can be mounted directly to a common support 315 moved by the primary actuator 310 while the other ends of the secondary actuator 302 actuate the common bar 313. Alternatively, individual bars may be used for each secondary actuator 302 as desired. Just prior to the splicing operation, the primary actuator 310 is preferably activated by the controller (not shown) in a manner similar that described in the first and second preferred embodiments above. The primary actuator 310 pulls the ply-bond wheels 306 and the bottoms of the vacuum belts (not shown for clarity) to a close position with respect to one another. Upon reaching this position, and when the time has come to begin ply-bonding the webs of material, passing between the ply-bond wheels 306, the controller preferably sends a signal to the secondary actuators 302. The secondary actuators 302 respond by quickly extending, thereby pushing the common bars 310 and the attached ply-bond wheels 306 towards one another. When it is desired to cease the ply-bonding operation, the controller preferably sends another signal to the secondary actuators 302 to quickly retract, pulling the common bars 310 and the attached ply-bond wheels 306 away from one another and the webs of material.

By employing a primary actuator 310 to move the vacuum belts and the ply-bond wheels 306 to a ready position and a series of fast secondary actuators 302 to quickly extend and retract to complete the ply-bonding operation, very precise ply-bonding can be achieved. In particular, the result of such a design is that ply-bonding marks which are necessary for the web bonding operation are only found on those portions of both webs to be bonded (no more web and no less web is affected).

The embodiments disclosed above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention as set forth in the appended claims.

For example, it will be appreciated by one having ordinary skill in the art that any number of vacuum belts 56, 76 can be arranged on each splicer assembly 12, 14, respectively. The vacuum belts 56, 76 need not all be of the same width or shape. In this regard it should be noted that the vacuum boxes 66,86 underlying the vacuum belts 56, 76 can be of any shape or size and preferably match the shape and size of the vacuum belts 56, 76. A splicer assembly employing a very small number of vacuum belts 56, 76 (e.g., one, two, or three belts) could also employ a similarly smaller number of vacuum boxes 66, 86. Also, such a splicer assembly would necessarily have a limited number of ply-bond wheels, 110, 112 according to the splicer assembly design described above. However, in such a case, it would be preferred to mount more (or all) ply-bond wheels 110, 112 for rotation on a separate shaft rather than on lower shafts 64, 84. Such an arrangement would require a connection between the separate ply-bond wheel shaft and the lower shafts 64, 84 in order to maintain the ply-bond wheels 110, 112 at a surface speed equal to the vacuum belt speed and to keep the ply-bond wheels 110, 112 in line with the lower ends of the vacuum belts 56, 76 during splicing operations. Alternate arrangements such as that just described fall within the spirit and scope of the present invention.

As another example of various apparatus arrangements and components which fall within the breadth of the present invention, the particular drive system which is described above and illustrated in the drawings need not necessarily consist of the particular elements and arrangement disclosed. In particular, a number of conventional methods and systems exist for rotating the upper shafts 62, 82 instead of the belt motor 68, 88 and drive belt 70, 90 arrangement disclosed. The upper shafts 62, 82 can be driven by an in-line motor, by a gear train, or by a number of other systems and methods which are well-known to those skilled in the art and which therefore are considered to fall within the spirit and scope of the present invention. Additionally, though the upper shafts 62, 82 are the driven shafts as disclosed, it is possible to instead drive the lower shafts 64, 84 in a similar fashion. In fact, it can be desirable to drive both the upper shafts 62, 82 and lower shafts 64, 84 in a manner similar to that disclosed in the present application. Also, Per than employ upper pulleys 58, 60 lower pulleys 78, 80, the vacuum belts 56, 76 can be wound around a non-slip surface of upper shafts 62, 82 and lower shafts 64, 84, or can be provided with a non-slip material on the underside of the vacuum belts 56, 76 which contacts and rides upon upper shafts 62, 82 and lower shafts 64, 84. Alternately, the vacuum belts 56, 76 can be provided with holes (or teeth) with mesh with teeth (or holes) within upper pulleys 58, 60 and lower pulleys 78, 80 around which the vacuum belts 56, 76 run. These and other belt driving arrangements and methods are well-known to those skilled in the art and are also considered to fall within the spirit and scope of the present invention.

Although the embodiments of the present invention disclosed above have a set of holes 96 located in a particular location on the vacuum belts 56, 76, it will be appreciated by one having ordinary skill in the art that a number of hole arrangements and locations are possible and can achieve the desired results of the splicer apparatus. For example, it is possible to have a series of holes 96 which are located entirely along the length of the vacuum belts 56, 76. In this arrangement, the desired release and/or capture of the webs 16, 20 on the vacuum belts 56, 76 at their designated times (see the description above) could be facilitated in other manners, such as by turning off or turning on the vacuum blowers 72, 92 at precise times, etc. Other hole patterns and arrangements matching, for example, various vacuum box 66, 86 configurations or belt shapes are also possible. Such alternative arrangements are well-known in the art and therefore also fall within the spirit and scope of the present invention.

Finally, it will be appreciated by one having ordinary skill in the art that the sensors utilized in the embodiments described above and illustrated in the figures can be of a variety of types commonly known in the art, such as motion sensors, light sensors, etc. Also, rather than employ sensors, it is possible (though not preferred to visually monitor any or all of the objects monitored herein by sensors and to control the operations of the splicer apparatus 10 manually rather than by use of a controller.

What is claimed is:

1. A method of splicing a first web of material to a second web of moving material, comprising the steps of:

moving the first web of material to a position adjacent to a belt and between the belt and the second web of moving material;

moving the belt toward the second web of moving material to push the first web of material toward the second web of moving material;

rotating the belt;

accelerating the first web of material to a speed of the second web of material; and passing the first and second webs of material through a pressure-bonding mechanism;

actuating the pressure-bonding mechanism to bond the first and second webs of material together.

2. The method as claimed in claim 1, wherein actuating the pressure-bonding mechanism includes bringing at least one pair of ply-bond wheels together to compress the first and second webs of material therebetween.

3. The method as claimed in claim 1, wherein the belt is a first belt, the method further comprising the steps of:

providing a second belt adjacent to the second web of moving material, the second web of moving material running between the second belt and the first web of material; and moving the second belt toward the first web of material to push the second web of moving material toward the first web of material.

4. The method as claimed in claim 1, further comprising the steps of:

moving the first web of material at least partially about a selectively drivable rotation element; and driving the rotation element during rotation of the belt and acceleration of the first web of material to transfer web tension upstream of the rotation element.

5. The method as claimed in claim 4, wherein the rotation element is upstream of the belt.

6. The method as claimed in claim 1, Wherein:

the belt is passed about a first rotating element and a second rotating element; and moving the belt toward the second web of moving material includes pivoting the belt about the first rotating element to bring the second rotating element closer to the second web of moving material.

7. The method as claimed in claim 1, further comprising holding the first web of material against the belt by vacuum force exerted through the belt.

8. A method of splicing a first web of material to a second web of moving material, comprising the steps of:

moving the second web of moving material through a first path;

passing the first web of material at least partially around a rotatable roll;

moving the first web of material partly through a second path to a position adjacent to the first path;

changing the second path to define a third path intersecting with the first path;

accelerating the first web of material through the third path to bring the first web of material into contact with the second web of moving material;

drawing the first and second webs of material through a rotatable pressure-bonding mechanism;

actuating the rotatable pressure-bonding mechanism to bond the first and second webs of material together;

driving the rotatable roll while actuating the rotatable pressure-bonding mechanism;

transferring slack in the first web by driving the rotatable roll, the rotatable roll transferring slack of the first web from upstream of the rotatable roll to a part of the first web between the rotatable roll and the pressure-bonding mechanism;

reducing tension of the first web between the rotatable roll and the pressure-bonding mechanism by transferring slack in the first web; and holding the first web of material against a movable surface while the first web of material is accelerated.

9. The method as claimed in claim 8, wherein moving the first web of material includes feeding the first web of material to a position adjacent to a rotating element.

10. The method as claimed in claim 9, wherein the rotating element is a belt.

11. The method as claimed in claim 8, wherein the first web of material is substantially free throughout the second path from contact with the second web of moving material.

12. The method as claimed in claim 8, wherein:

changing the second path includes moving a rotation element closer to the second web of moving material; and the first web of material is pushed closer to the second web of moving material by movement of the rotation element.

13. The method as claimed in claim 12, wherein the rotation element is at least one roller.

14. The method as claimed in claim 12, wherein the rotation element is at least part of at least one belt.

15. The method as claimed in claim 8, wherein the movable surface is at least one vacuum belt.

16. The method as claimed in claim 8, further comprising changing the first path to define a fourth path intersecting with the third path.

17. The method as claimed in claim 16, wherein changing the first path includes moving a rotation element closer to the first web of material; and the second web of moving material is pushed closer to the first web of material by movement of the rotation element.

18. A method of splicing a first web of material to a second web of moving material in a web splicer, comprising the steps of:

providing a web path through the splicer through which the first web of material is movable;

passing the first web of material at least partially around a rotatable roll;

passing the first web of material partly through the web path;

moving an end of the first web of material toward the second web of material to change the web path taken by the first web through the splicer;

accelerating the first web of material to a speed of the second web of moving material;

passing the first and second webs of material through a rotatable pressure-bonding mechanism;

actuating the rotatable pressure-bonding mechanism to bond the first and second webs of material together;

driving the rotatable roll while actuating the rotatable pressure-bonding mechanism;

transferring slack in the first web by driving the rotatable roll, the rotatable roll transferring slack of the first web from upstream of the rotatable roll to a part of the first web between the rotatable roll and the pressure-bonding mechanism;

reducing tension of the first web, between the rotatable roll and the pressure-bonding mechanism by transferring slack in the first web; and holding the first web against a surface while the first web is accelerated.

19. The method as claimed in claim 18, wherein the first web of material is moved via an actuator pushing the first web of material into a different web path.

20. The method as claimed 19, wherein the first web is moved by a rotation element actuated by the actuator.

21. The method as claimed in claim 20, the rotation element is at least one roller.

22. The method as claimed in claim 20, wherein the rotation element is at least part of at least one belt.

23. The method as claimed in claim 18, wherein the first web is held via vacuum force against the surface.

24. The method as claimed in claim 18, wherein the first web of material is moved by a rotation element.

25. The method as claimed in claim 24, wherein the rotation element is at least one roller.

26. The method as claimed in claim 24, wherein the rotation element is at least one belt.

27. The method as claimed in claim 18, further comprising moving the second web of moving material toward the first web of material to change a web path taken by the second web of moving material through the splicer.

28. A flying web splicer for splicing a first web of material to a second web of moving material, comprising:

first and second web paths through which the first web of material is movable;

a first actuator movable to divert the first web of material from the first web path to the second web path in intersecting relationship with the second web of moving material; and a rotatable pressure-bonding mechanism through which the first and second webs are movable to bond the first web to the second web;

a rotatable roll located upstream of the rotatable pressure-bonding mechanism and about which the first web is movable, the rotatable roll powered to transfer slack in the first web from upstream of the rotatable roll to a location between the rotatable roll and the rotatable pressure-bonding mechanism; and a movable surface against which the first web is held while the first and second webs are being bonded by the rotatable pressure-bonding mechanism.

29. The splicer as claimed in claim 28, further comprising:

third and fourth web paths through which the second web of material is movable; and a second actuator movable to divert the second web of moving material from the third web path to the fourth web path in intersecting relationship with the first web of material in the second web path.

30. The splicer as claimed in claim 28, further comprising a rotation element coupled to the first actuator and movable by the first actuator to divert the first web of material from the first web path to the second web path.

31. The splicer as claimed in claim 30, wherein the rotation element is at least one roller.

32. The splicer as claimed in claim 30, wherein the rotation element is at least one belt.

33. The splicer as claimed in claim 28, wherein the rotatable pressure-bonding mechanism includes at least one pair of ply-bond rolls between which the first and second webs can be passed.

34. The splicer as claimed in claim 28, further comprising at least one belt driving the first web of material through at least the second web path.

35. The splicer as claimed in claim 34, wherein the belt is a vacuum belt adapted to hold and drag the first web of material via suction force therethrough.

* * * * *